US007272935B1

(12) United States Patent
Wolf

(10) Patent No.: US 7,272,935 B1
(45) Date of Patent: Sep. 25, 2007

(54) DEVICE AND METHOD FOR FORMING ICE AROUND A BOTTLE

(75) Inventor: J. Davis Wolf, Naples, FL (US)

(73) Assignee: Ice Jacket, Inc., Naples, FL (US)

( * ) Notice: Subject to any disclaimer, the term of this patent is extended or adjusted under 35 U.S.C. 154(b) by 0 days.

(21) Appl. No.: 11/422,686

(22) Filed: Jun. 7, 2006

(51) Int. Cl.
*F25C 1/00* (2006.01)

(52) U.S. Cl. ..... 62/1; 62/59; 62/66; 62/340; 62/457.3; 62/457.4; 249/83

(58) Field of Classification Search ..... 62/1, 62/59, 60, 66, 340, 457.3, 457.4, 457.8; 220/625, 220/737, 903; 264/28, 301, 304; 249/83, 249/91, 96, 117, 160; 425/275
See application file for complete search history.

(56) References Cited

U.S. PATENT DOCUMENTS 1,943,384 A * 1/1934 Hall ..... 426/390
2,629,515 A * 2/1953 Asplund ..... 62/1
4,543,801 A * 10/1985 Damiens ..... 62/457.8
4,625,518 A * 12/1986 Freedman ..... 62/1
5,148,682 A * 9/1992 Wolf ..... 62/59
5,177,981 A * 1/1993 Haas ..... 62/457.3
5,444,992 A * 8/1995 Bell ..... 62/372
5,651,254 A * 7/1997 Berry ..... 62/1
6,751,982 B2 * 6/2004 Horen ..... 62/457.4

* cited by examiner

*Primary Examiner*—William E. Tapolcai
(74) *Attorney, Agent, or Firm*—Jeffrey D. Moy; Weiss & Moy, P.C.

(57) ABSTRACT

A device for forming ice around an exterior surface of a container has an upper piece. The upper piece is an elongated tubular member having a hollow interior section and an open bottom and top end. A gasket assembly is coupled to an upper interior section of the upper piece. The gasket assembly creates a seal around a neck of the container to prevent water from rising above the neck of the container. A lower piece is provided and has an open top end and an opening formed in the bottom surface thereof. The open bottom end of the upper piece will mate with the open top end of the lower piece to form a watertight seal. A raised floor is formed in a bottom interior section of the lower piece. The raised floor allows water to collect and freeze underneath the bottom of the container. A cap is provided to close the opening in the bottom surface of the lower piece.

21 Claims, 8 Drawing Sheets

DEVICE AND METHOD FOR FORMING ICE AROUND A BOTTLE

RELATED APPLICATION

This application is related to U.S. Pat. No. 5,148,682, issued on Sep. 22, 1992 in the name of the same inventor as the present application. The above patent application is hereby incorporated by reference.

FIELD OF THE INVENTION

This invention generally relates to devices and methods used to cool beverages and, more specifically, to a device and method for cooling beverage containers holding a liquid that freezes at colder temperatures than water by forming ice around the exterior surface of the container.

BACKGROUND OF THE INVENTION

It is well known that many beverages are enjoyed by consumers when chilled. One way of chilling a beverage is to place ice cubes in a container (e.g., a glass) that holds the beverage. Another way to chill a beverage is to place the container holding the beverage in a refrigerator or freezer before consuming the beverage. Both of these methods of chilling a beverage have a common shortcoming in that their effects eventually dissipate, usually during the ordinary time that one would take to consume the beverage. For example, the ice cubes will often melt before the consumption of the beverage is complete. The ice cube method of cooling has the additional shortcoming of diluting the beverage with water, which can affect the taste of beverages other than water. With the refrigeration method of cooling, the beverage container used outside of the refrigerator eventually warms to room temperature, as does the beverage.

There have been a number of attempts in the prior art to design a device and method that permits continuous cooling of a beverage within a container. For example, U.S. Pat. No. 4,543,801 to Damiens discloses a cool beverage carafe server wherein a ring of ice is formed around a carafe whose overall configuration is critically important. The carafe disclosed in the Damiens patent must have an elongated neck which may conveniently be hand-held as a handle. In addition, it is required that the main body portion of the carafe have a bulbous shape such that it will retain a solid ice ring captured thereon in an encircling relationship. As disclosed in the Damiens patent, the user of that device must take the liquid desired to be cooled (e.g., alcohol) and pour it from its original container into the pre-formed carafe. After the carafe is filled with the liquid beverage, the bulbous body portion is placed down into a water-filled mold so that the water largely covers the bulbous portion. The carafe and mold are then placed in a freezer in a vertical position until the water freezes around the bulbous portion. Once the water is frozen, the carafe is removed from the mold and utilized in conjunction with a tray that can collect ice drippings as the ice ring melts.

Another attempt at designing an apparatus for continuously cooling a beverage is shown in U.S. Pat. No. 2,048,041 issued to Warren et al. The Warren patent discloses a method and apparatus for serving ice drinks wherein a mold in the shape of a truncated cone is inverted and a glass for holding the beverage to be cooled is placed in an inverted position therein. The mold is filled with ice and turned back over into an upright position. After the ice hardens around the glass, the mold is removed, leaving a glass surrounded by an ice ring in the shape of a truncated cone. The Warren patent does not suggest how to cool a bottle of liquor and it is difficult to grip the ice ring clad glass.

Some other attempts at designing a device to perform a similar function are shown in U.S. Pat. No. 2,091,723 issued to Sterino, U.S. Pat. No. 1,943,384 issued to Hall and U.S. Pat. No. 662,541 issued to Miskolczy.

These patents do not disclose a device that easily permits an ice mold to be formed directly around the original and unopened container in which the beverage is packaged. For example, if one wanted to form a mold around an originally-manufactured glass bottle containing vodka caped or enclosed therein, none of the devices disclosed in these patents would work very well to achieve that objective. Moreover, if one wanted to similarly prepare a number of bottles at one time and in one freezer, there is very little flexibility in the position that these devices can rest in while ice is forming around the container. Moreover, there is less than an optimum amount of stability in these devices. If one were to bump the device disclosed in the Damiens patent, water could easily spill out of the mold and adversely affect the performance of the device.

Therefore, a need exists to provide a device and method to overcome the above problem. The device and method will permit formation of ice around a beverage container. The device and method will permit formation of ice around a variety of different shapes of bottles, including the bottles originally utilized by the manufacturer of various beverages such as alcohols and liquors. The device and method will permit the formation of ice around a beverage container where the device can be placed in a number of positions and still permit the ice to form.

SUMMARY OF THE INVENTION

In accordance with one embodiment of the present invention, it is an object of the present invention to provide a device and method that overcomes the problems associated with prior art devices.

It is another object of the present invention to provide a device and method that will form ice around a beverage container.

It is still another object of the present invention to provide a device and method that will permit formation of ice around a variety of different shapes of bottles, including the bottles originally utilized by the manufacturer of various beverages such as alcohols and liquors.

It is yet another object of the present invention to provide a device and method that will permit the formation of ice around a beverage container where the device can be placed in a number of positions and still permit the ice to form.

BRIEF DESCRIPTION OF THE EMBODIMENTS

In accordance with one embodiment of the present invention, a device for forming ice around an exterior surface of a container is disclosed. The device has an upper piece. The upper piece is an elongated tubular member having a hollow interior section and an open bottom and top end. A gasket assembly is coupled to an upper interior section of the upper piece. The gasket assembly creates a seal around a neck of the container to prevent water from rising above the neck of the container. A lower pieces provided and has an open top end and an opening formed in the bottom surface. The open bottom end of the upper piece will mate with the open top end of the lower piece to form a watertight seal. A raised floor is formed in a bottom interior section of the lower piece. The raised floor allows water to collect and freeze underneath the bottom of the container. A cap is provided to close the opening in the bottom surface of the lower piece.

In accordance with another embodiment of the present invention, a device for forming ice around an exterior surface of a container is disclosed. The device has an upper piece. The upper piece is an elongated tubular member having a hollow interior section and an open bottom and top end. A first lip member is formed around an outer perimeter of the open bottom end of the upper piece. A gasket assembly is coupled to an upper interior section of the upper piece and forms a seal around a neck of the container. A lower piece is provided and has an open top end and an opening formed in the bottom surface of the lower piece. A raised floor is formed in a bottom interior section of the lower piece that allows water to collect and freeze underneath the bottom of the container. A second lip member is formed around an outer perimeter of the open top end of the lower member. A rubber seal positioned between the first lip member and the second lip member forms a watertight seal when the open bottom end of the upper piece mates with the open top end of the lower piece. A plurality of connectors is provided to secure the upper piece to the lower piece. A cap is provided to close the opening in the bottom surface of the lower piece.

The foregoing and other objects, features, and advantages of the invention will be apparent from the following, more particular, descriptions of the preferred embodiments of the invention, as illustrated in the accompanying drawing.

BRIEF DESCRIPTION OF THE DRAWINGS

Common reference numerals are used throughout the drawings and detailed description to indicate like elements.

DETAILED DESCRIPTION

Figure 1:
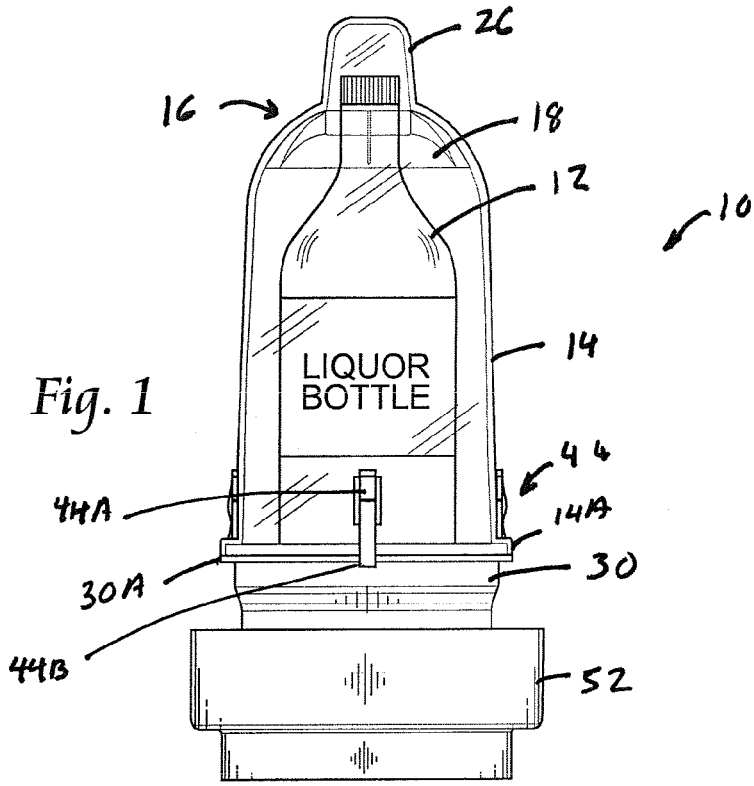
FIG. 1 is a front view of one embodiment of the present invention.
Figure 2:
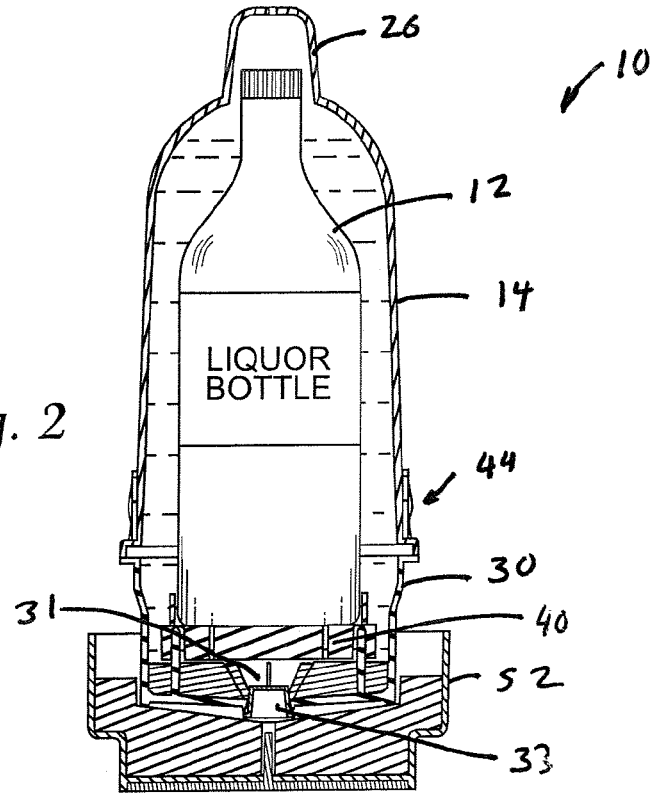
FIG. 2 is a partial cross-sectional view illustrating where the water/ice is located and the proper level of water within the present invention.
Figure 3:
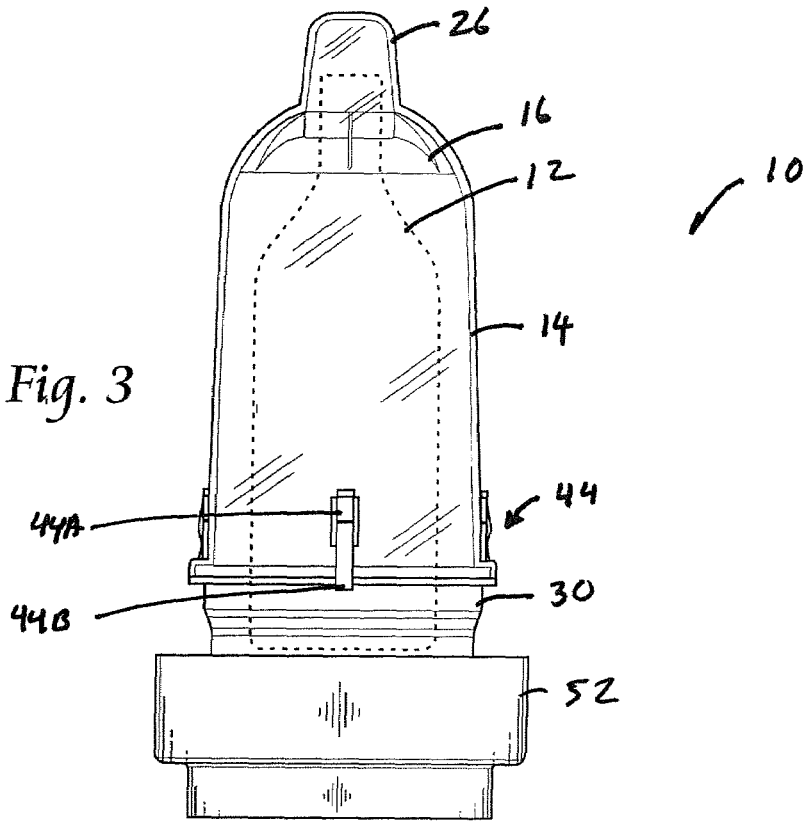
FIG. 3 is a solid front view to show the position of the bottle within the present invention.
Figure 4:
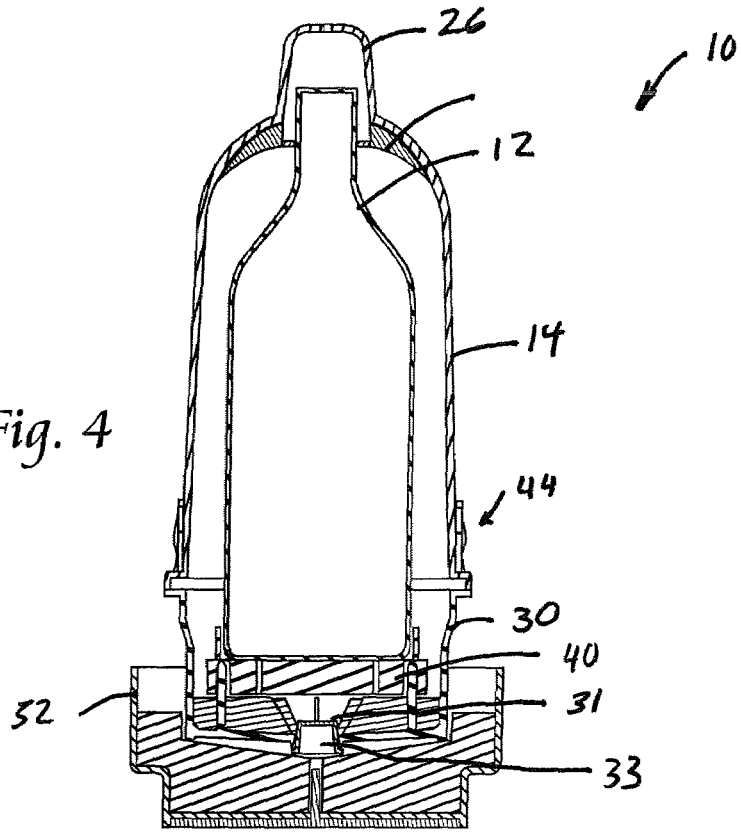
FIG. 4 is a full cross-sectional view of the present invention.
Figure 5:
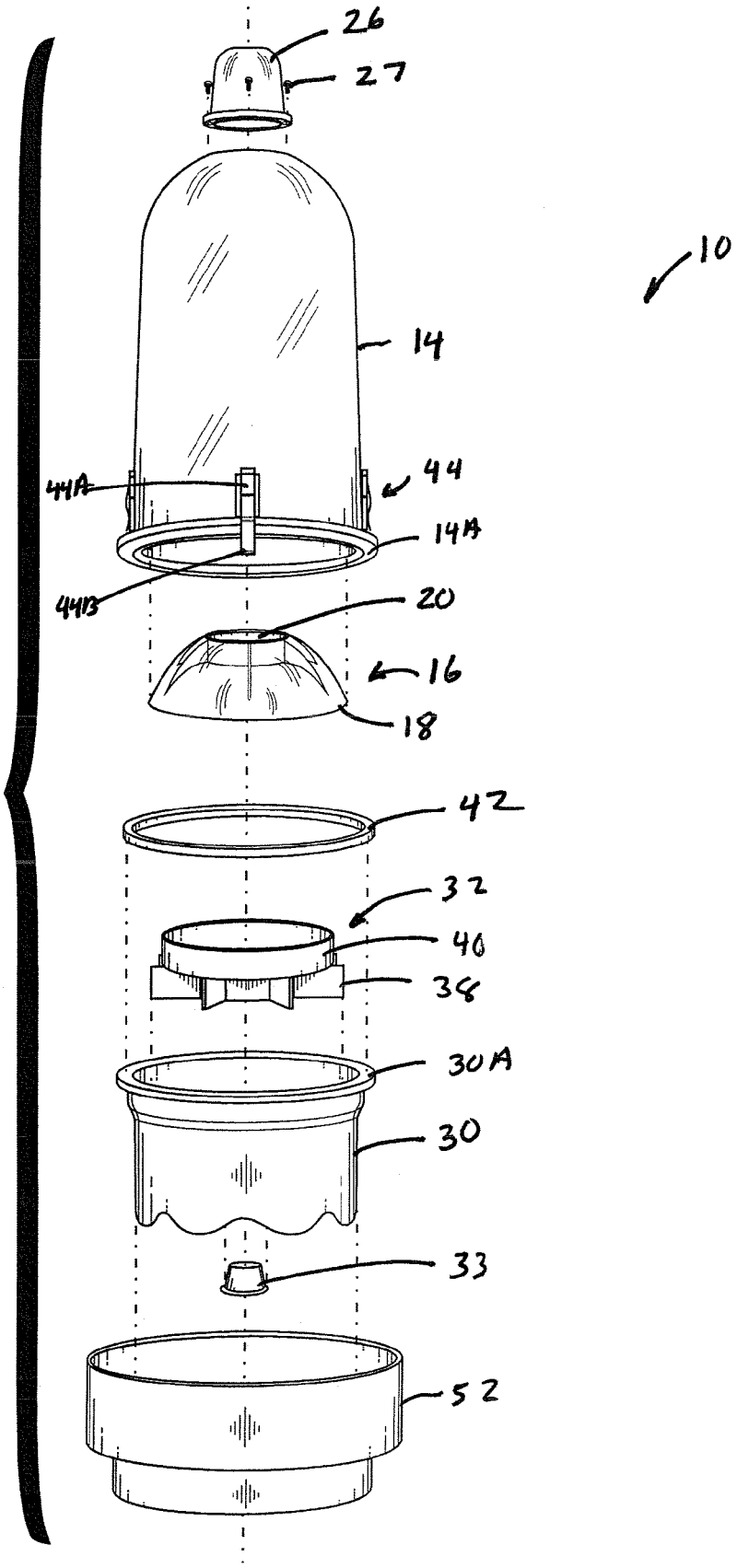
FIG. 5 is an exploded view of the embodiment depicted in FIG. 1.
Figure 6:
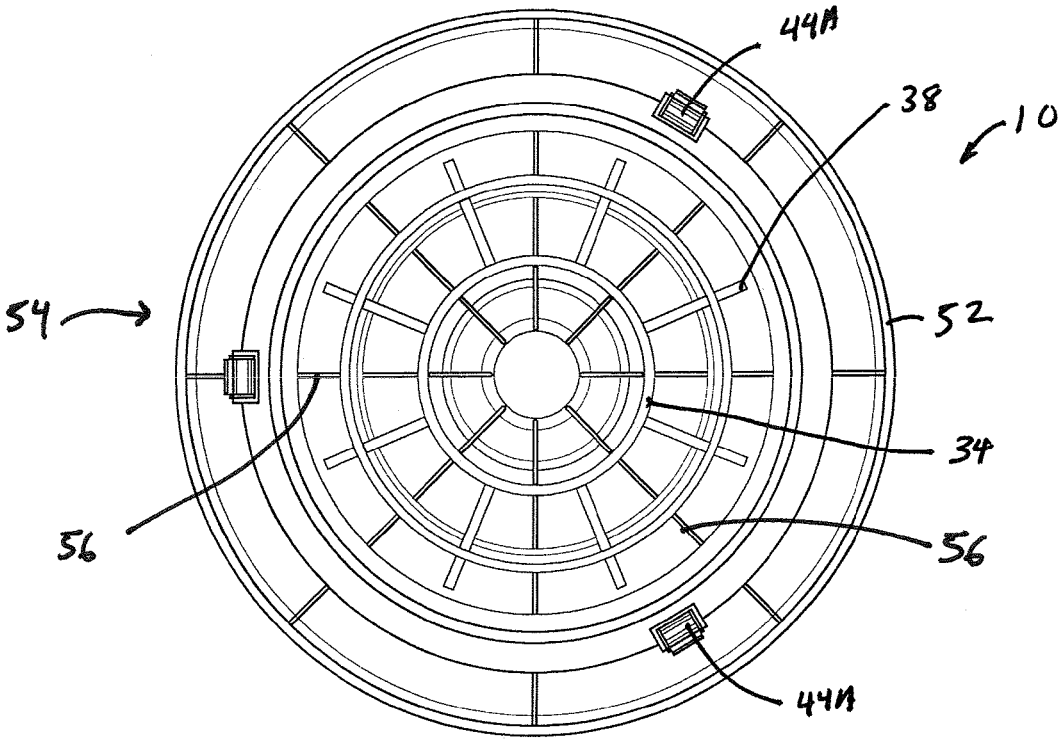
FIG. 6 is a top view of the embodiment depicted in FIG. 1.
Figure 7:
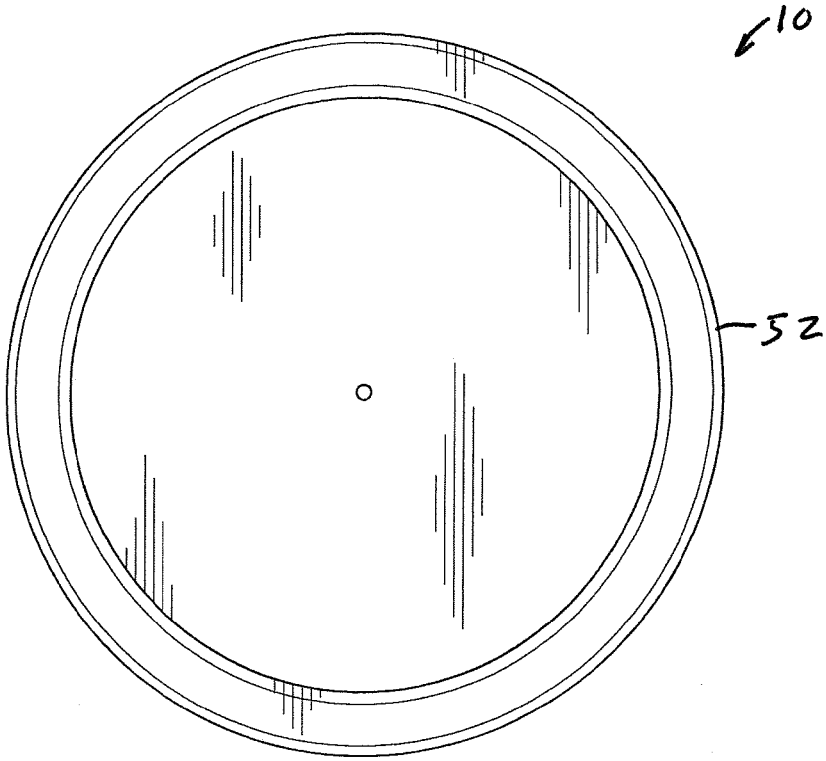
FIG. 7 is a bottom view of the embodiment depicted in FIG. 1.
Figure 8:
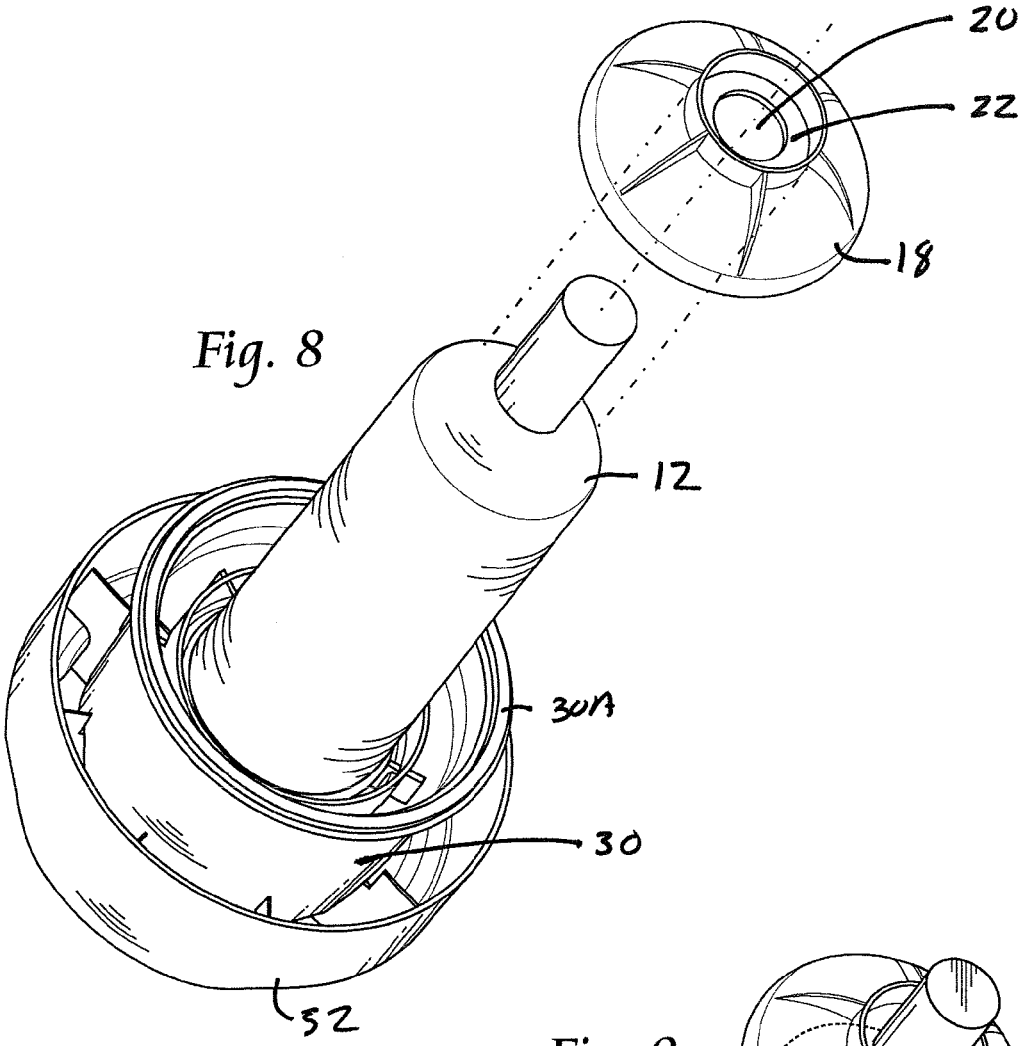
FIG. 8 is a perspective exploded view showing the gasket assembly used in the present invention.
Figure 9:
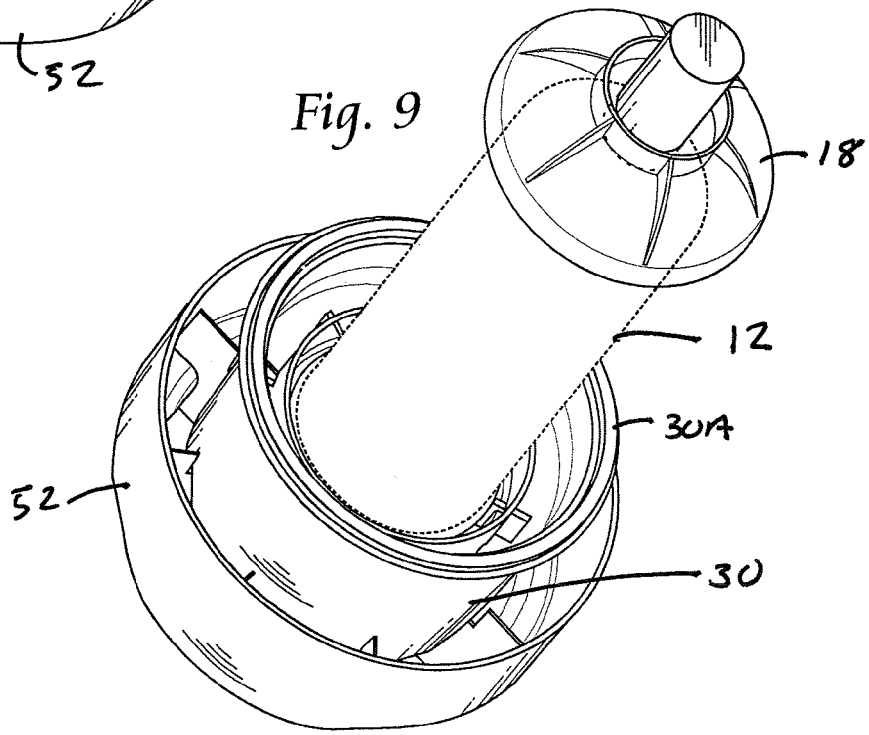
FIG. 9 is perspective view of the gasket assembly showing how it seals the neck of the bottle.
Figure 10:
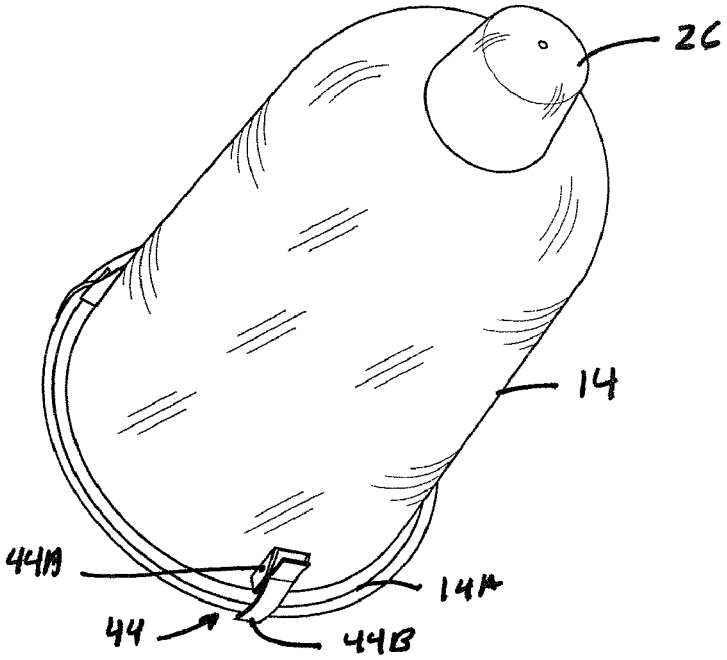
FIG. 10 is an elevated perspective view of the upper piece of the present invention.
Figure 11:
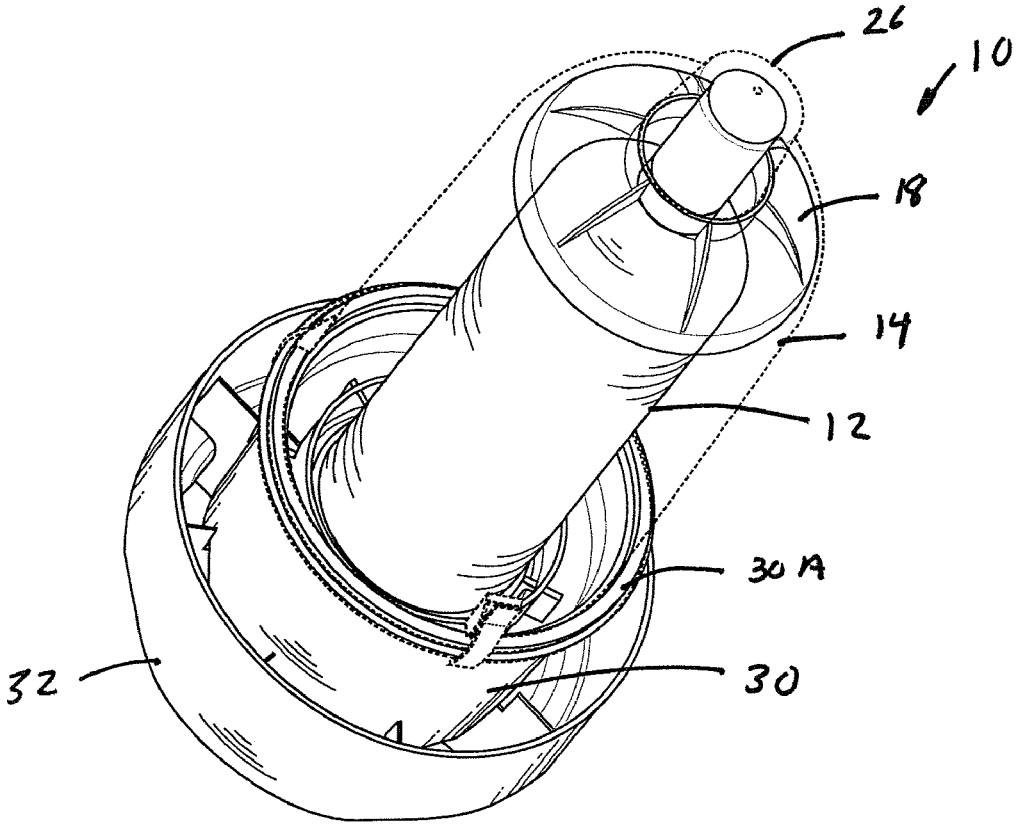
FIG. 11 is an elevated perspective view showing how the upper piece in phantom lines fits over the lower piece.
Figure 12:
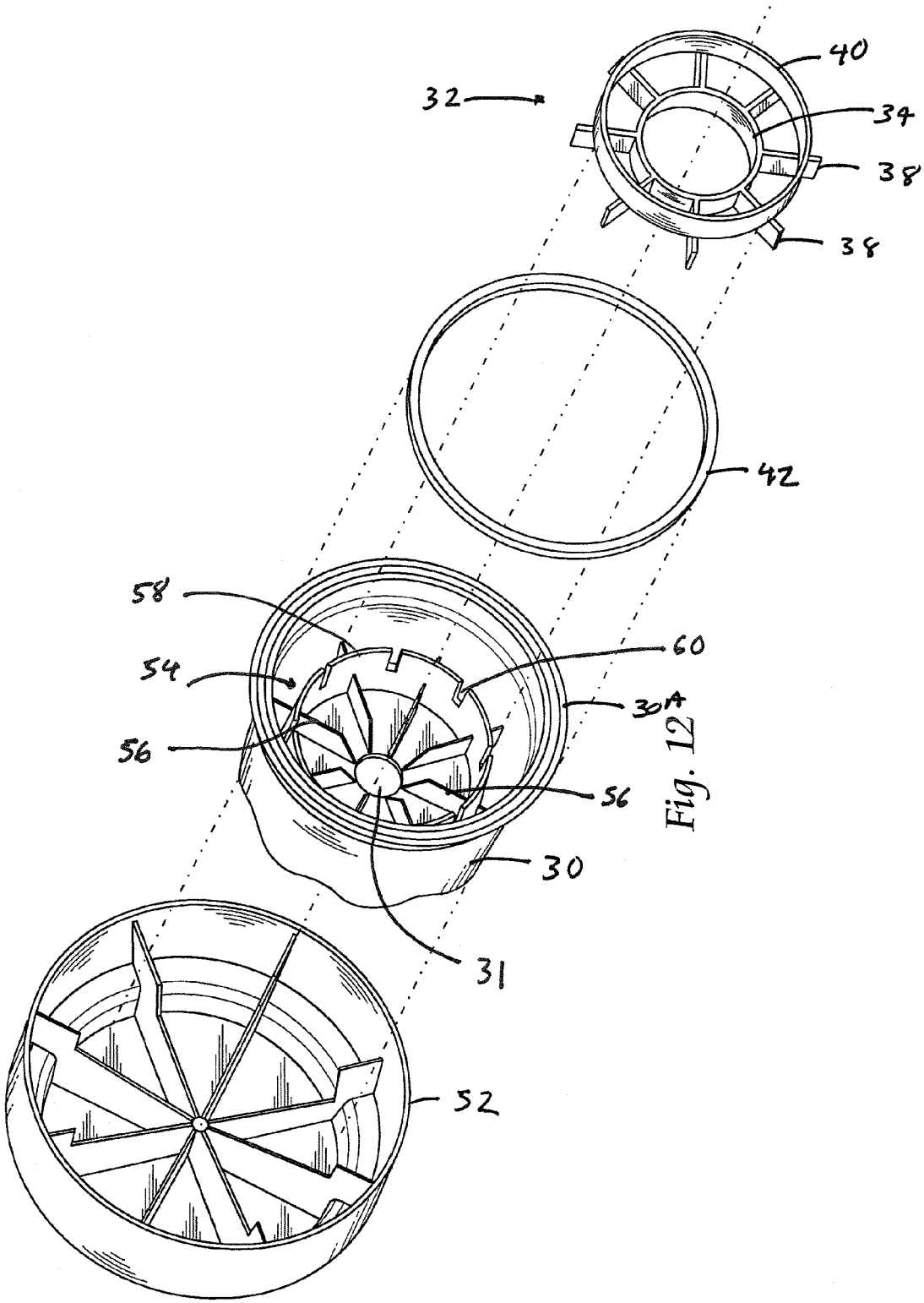
FIG. 12 is an exploded view of the bottom piece and the stand.

Referring to the Figures, a device 10 for forming ice around a beverage container 12 is shown. The device 10 is comprised of two main pieces. An upper piece 14 is an elongated tubular member having an open bottom and top end. The upper piece 14 has a hollow interior section. In general, the upper piece 14 is made from a molded plastic wherein the upper piece 14 is preferably of a shape that generally follows the exterior shape of the container to be iced. The upper piece 14 must be of sufficient length or height so that upon inversion of the upper piece 14 and after insertion therein of the beverage container 12 to be iced, a substantial portion of the beverage container 12 will be covered by water. Further, when the beverage container 14 is positioned in the device 10, the top and neck of the beverage container 12 will extend through the open top end of the upper piece 14.

Located in an upper interior section of the upper piece 14 is a gasket assembly 16. The gasket assembly 16 creates a seal around the neck of the beverage container 12 to prevent water from rising beyond the neck of the subject beverage container 12. The gasket assembly 16 ensures that the cap of the beverage container 12 is not subject to the formation of ice there around. The gasket assembly 16 further allows the device 10 to be placed in any position during the freezing process since the gasket assembly 16 will prevent water from rising and freezing beyond the neck of the subject beverage container 12. The gasket assembly 16 eliminates the need to have the device 10 stand upright during the freezing process and ensures satisfactory performance of the device 10 regardless of the position in which the device 10 is placed within the freezer prior to the freezing process.

The gasket assembly 16 has a body section 18 which is removably coupled to the upper piece 14. The body section 18 has rounded exterior surface that conforms to the interior upper surface of the upper piece 14. An opening 20 is formed in a central region of the body section 18. The opening 20 allows the top and neck of the beverage container 12 to extend through the body section 20 and out of the opening in the top of the upper piece 14. A gasket 22 is coupled around the opening 20. The gasket 22 will form a seal around the neck of the beverage container 12 when the neck is extended through the body section 18 and out the open end at the top of the upper piece. The gasket 22 will prevent water from rising and freezing beyond the neck of the subject beverage container 12.

In accordance with one embodiment of the present invention, the device 10 may come with a protrusion 26. The protrusion 26 would be removably coupled to the open top end of the upper piece 14 to close the open top end. The protrusion 26 is removably coupled to the top open end by a plurality of connectors 27. The protrusion 26 is hollow and extends up from the top surface of the upper piece 14. When a beverage container 12 is positioned in the device 10, the top and neck of the beverage container 12 will extend through the opening 20 in the body section 18 of the gasket assembly 16 and into the hollow interior of the protrusion 26.

The device 10 will function and work without the protrusion 26. The gasket assembly 16 eliminates the need for the protrusion 26. However, the protrusion 26 may be used as a fail safe device to ensure no water spills out should the device 10 be placed on a side during the freezing process and the gasket assembly 16 fails for one reason or another. The protrusion 16 may further be used so that the device 10 is sealed, thus speeding up the freezing process.

A lower (base) piece 30 is of a shorter height than the elongated upper piece 14. The lower piece 30 has an open top end. A small opening 31 is formed in the bottom surface of the lower piece 30 to allow one to fill the device 10 with water when the top piece 14 and bottom piece 30 are coupled together. A cap 33 is used to close the opening 31.

The lower piece 30 will have a raised floor 54 formed in the bottom interior of the lower piece 30. The raised floor 54 will allow water to collect and freeze underneath the bottom of the beverage container 12. The raised floor 54 has a plurality of raised slats 56. The raised slats 56 extend from an interior side wall of the lower piece towards the opening 31. The raised slats 56 will allow the beverage container 12 to placed above a bottom surface of the lower piece 30 so that water to collect and freeze underneath the bottom of the beverage container 12. A ring member 58 is coupled to and rises above the raised slats 56. The ring member 58 is used to guide the beverage container 12 into position and to maintain the position of the beverage container 12 in the event the device 10 is not placed in an upright orientation within the freezer.

The lower piece 30 may further have a raised grating platform 32 which may be removably coupled to the raised floor 54 of the lower piece 30. The raised grating platform 32 is generally used to elevate shorter beverage containers 12 within the device 10. Raising shorter beverage containers 12 serves two main purposes: 1) to enhance the aesthetic value and 2) to increase the height of the neck of the beverage container 12 so that the gasket assembly 16 properly ensures that water does not freeze around the cap of the shorter beverage container 12. The raised grating platform 32 increases the functionality and capability of the device 10 by allowing a wider variety and number of beverage containers 12 to be accommodated therein.

In accordance with one embodiment of the present invention, the raised floor 54 has a plurality of slots 60. The slots 60 are formed in the ring member 58. The slots 58 are used to hold the raised grating platform 32 in position. In this embodiment, the raised grating platform 32 has a circular body member 34 having a central opening 36. A plurality of members 38 extend out and away from the circular body member 34. Each of the plurality of members 38 will be positioned in one slot 60 to secure the raised grating platform 32 to the raised floor 54. When the raised grating platform 32 is positioned on the raised floor 54 of the lower piece 30, the bottom portion of the beverage container 12 can rest on the circular body member and the plurality of members 38 extending out and away from the circular body member 34. A circular ridge 40 extends up from the plurality of members 38. The circular ridge 40 is used to guide the beverage container 12 into position. The circular ridge 40 is further used to maintain the position of the beverage container 12 in the event the device is not placed in an upright orientation within the freezer.

Both the upper piece 14 and lower piece 30 are designed to mate with each other and form a watertight seal. In accordance with one embodiment of the present invention, the upper piece 14 will have a lip member 14A form around the outer perimeter of the open bottom end. The lower piece 30 will have a lip member 30A formed around an outer perimeter of the open top end. A rubber seal 42 may be placed on top of the either lip member 14A or 30A. When the upper piece 14 is placed on top of the lower piece 30 so that the lip member 14A is placed on top of the lip member 30A, the rubber seal 42 will form a watertight seal between the upper piece 14 and the lower piece 30.

In order to secure the upper piece 14 to the lower piece 30 and to ensure a watertight seal, a plurality of connectors 44 are used to secure the upper piece 14 to the lower piece 30. In the embodiment depicted in the Figures, the connectors 44 are a plurality of latches. As shown in the Figures, the latches have a body section 44A coupled to a bottom section of the upper piece 14. The body section 44A is positioned above the lip member 14A of the upper piece 14. Each latch will have a hook member 44B which engages the lip 30A of the lower piece 30. Pulling the latch towards the device 10 will tighten the hook member 44B under the lip 30A of the lower piece 30 to ensure a watertight seal.

The upper piece 14 and lower piece 30 may mate with each other and form a watertight seal in other ways. For example, the bottom piece 30 may have a channeling which runs around the outer perimeter of the open top end of the lower piece 30. An edge along the bottom open end of the upper piece 14 is then inserted into the channeling to form a watertight seal between the upper piece 14 and lower piece 30. Alternatively, a common threaded arrangement, which permits the upper piece 14 and lower piece 30 to be screwed together, is another means for mating the two pieces. Threads on the upper piece 14 and threads on the lower piece 30 provide for such a mating or connection.

Figure 13:
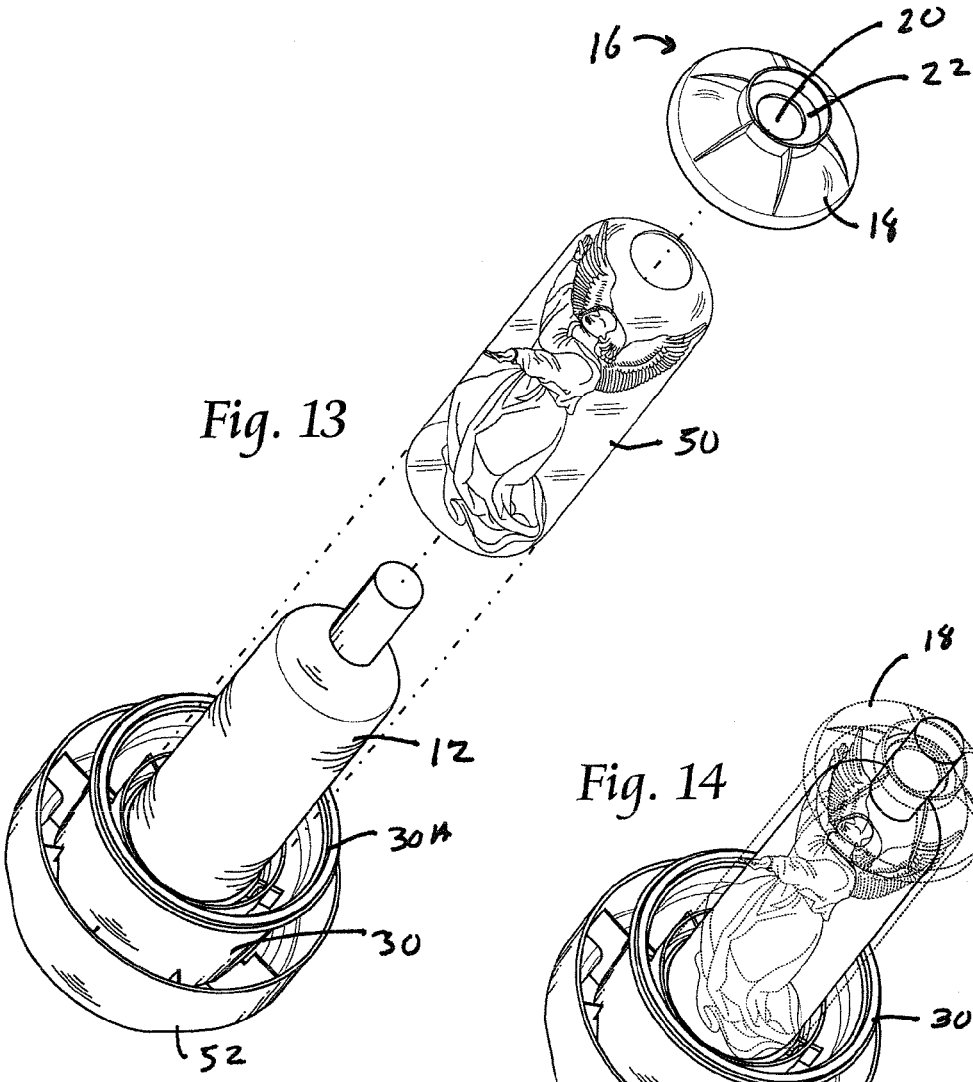
FIG. 13 is an exploded view of another embodiment of the present invention showing the use of a mold.
Figure 14:
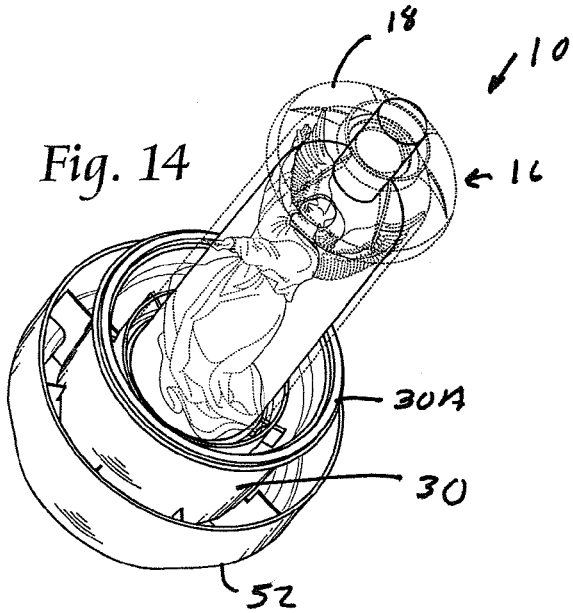
FIG. 14 is an elevated perspective view of the embodiment depicted in FIG. 13.
Figure 15:
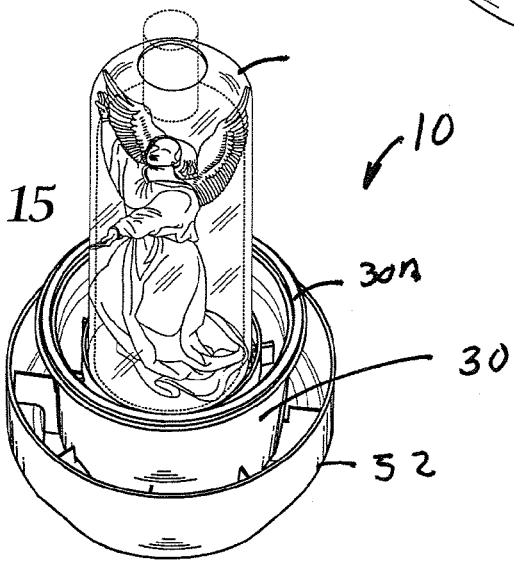
FIG. 15 is an elevated front view of the embodiment depicted in FIG. 13.

In order to form more decorative ice figure around the beverage container 12, a mold 50, form or objects (hereinafter mold 50) may be inserted into the upper piece 14. The mold 50 may be of any type of design. As shown in the FIGS. 13-15, the mold 50 is formed in the shape of an angel. However, the mold 50 may be formed in other shapes and figures without departing from the spirit and scope of the present invention.

In operation, the upper piece 14 is first removed/disconnected from the lower piece 30. A beverage container 12 is then placed on the raised floor 54. The beverage container 12 is positioned on the raised floor 54 so that the beverage container 12 is positioned within the ring member 58. The ring member 58 is used to guide the beverage container 12 into position and to maintain the position of the beverage container 12 in the event the device 10 is not placed in an upright orientation within the freezer.

For shorter beverage containers 12, the raised grating platform 32 is placed on top of the raised floor 54 and the beverage container 12 is placed on top of the raised grating platform 32. The beverage container 12 is positioned on the raised grating platform 32 so that the bottom of the beverage container 12 is placed in the circular ridge 40 extending up from the plurality of members 38 of the raised grating platform 32. The circular ridge 40 is used to guide the beverage container 12 into position and to maintain the position of the beverage container 12 in the event the device 10 is not placed in an upright orientation within the freezer.

The upper piece 14 is then secured to the lower piece 30 to form a watertight seal. As shown in the Figures, the upper piece 14 is placed on top of the lower piece 30 so that the lip member 14A is placed on top of the lip member 30A. The rubber seal 42 is positioned between the lip member 14A and the lip member 30A to form a watertight seal between the upper piece 14 and the lower piece 30. The plurality of connectors 44 are then used to secure the upper piece 14 to the lower piece 30. In the embodiment depicted in the Figures, the connectors 44 are a plurality of latches. As shown in the Figures, the body section 44A of the latch is coupled to a bottom section of the upper piece 14. The body section 44A is positioned above the lip member 14A of the upper piece 14. Each latch will have a hook member 44B which engages the lip 30A of the lower piece 30. Pulling the latch towards the device 10 will tighten the hook member 44B under the lip 30A of the lower piece 30 to ensure a watertight seal.

Once a watertight seal is formed, water is poured into the device 10. Water may be poured into the device 10 via the opening 31 formed in the bottom surface of the lower piece 30. The water will fill around the space between the interior wall of the upper piece 14 and the exterior surface of the beverage container 12.

When the upper piece 14 was placed over the beverage container 12, the gasket assembly 16 creates a seal around the neck of the beverage container 12. The gasket assembly 16 will prevent water from rising beyond the neck of the subject beverage container 12 and ensures that the cap of the beverage container 12 is not subject to the formation of ice there around.

Once the device 10 is filled to the proper level with water, a cap 33 is used to close the opening 31. The device 10 may then be placed in a freezer so that the water may freeze so ice may form around the exterior surface of the beverage container 12. The device may be place in any position in the freezer. The gasket assembly 16 allows the device 10 to be placed in any position during the freezing process since the gasket assembly 16 will prevent water from rising and freezing beyond the neck of the subject beverage container 12. The gasket assembly 16 eliminates the need to have the device 10 stand upright during the freezing process and ensures satisfactory performance of the device 10 regardless of the position in which the device 10 is placed within the freezer prior to the freezing process.

Once the device 10 has been removed from the freezer, the device 10 may be placed in a tray 52. The tray 52 is intended to elevate the device 10 in order to make it easier to handle, and also for the purpose of enhancing the overall aesthetic value of the frozen beverage container 12. It should be noted that the lower (base) piece 30 provides adequate stability and does not require the tray 52 to perform this function. However, as stated above, the tray does help to elevate the device 10 in order to make it easier to handle, and also raises the frozen beverage container for the purpose of enhancing the overall aesthetic value of the frozen beverage container 12. The tray 50 is also used to catch any water that may leak out or catch any condensation that may form around the device 10.

After the water has frozen so ice has formed around the exterior surface of the beverage container 12, a person has several different options. If the protrusion 26 is not coupled to the top open end of the upper piece 14, a person may open the top of the beverage container 12 which is extends through the open top end of the upper piece 14. Once the beverage container top is opened, a user may pour from the beverage container 12 while the beverage container 12 is still contained in the device 10. This eliminates possible contact with the ice and may serve to slow the melting process and dripping associated therewith.

Alternatively, if the protrusion 26 is coupled to the top open end of the upper piece 14, a person may remove the protrusion 26 in order to expose the open top end of the upper piece 14. Once the protrusion 26 is removed, the top of the beverage container 12 will extends through the open top end of the upper piece 14. Once the beverage container top is opened, a user may pour from the beverage container 12 while the beverage container 12 is still contained in the device 10. This eliminates possible contact with the ice and may serve to slow the melting process and dripping associated therewith.

Alternatively, a person may separate the upper piece 14 from the lower piece 30. It does not matter whether the protrusion 26 is attached to the upper piece 14. As shown in the Figures, one must loosen the latches 44A. Once the latches 44A are loosened, the upper piece 14 may be removes. Ice has formed around the exterior surface of the beverage container 12. A user may then pour from the beverage container 12 once the top of the beverage container 12 has been removed.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A device for forming ice around an exterior surface of a container comprising:

an upper piece, the upper piece being an elongated tubular member having a hollow interior section and an open bottom and top end;

a gasket assembly coupled to an upper interior section of the upper piece, the gasket assembly creating a seal around a neck of the container to prevent water from rising above the neck of the container;

a lower piece having an open top end and an opening formed in the bottom surface of the lower piece, wherein the open bottom end of the upper piece will mate with the open top end of the lower piece to form a watertight seal;

a raised floor formed in a bottom interior section of the lower piece, the raised floor allowing water to collect and freeze underneath the bottom of the container; and a cap to close the opening in the bottom surface of the lower piece.

2. A device for forming ice around an exterior surface of a container in accordance with claim 1 further comprising:

a protrusion removably coupled to the top open end of the upper piece, the protrusion having a hollow interior section and extending up from the top open end of the upper piece; and a plurality of connectors for removably coupling the protrusion to the top open end of the upper piece.

3. A device for forming ice around an exterior surface of a container in accordance with claim 1 wherein the gasket assembly comprises:

a body section removably coupled to the upper interior section of the upper piece;

an opening formed in a central region of the body section; and a gasket coupled around the opening in the body section.

4. A device for forming ice around an exterior surface of a container in accordance with claim 1 further comprising a raised grating platform removably coupled to the raised floor, the raised grating platform is used to elevate shorter beverage containers within the device.

5. A device for forming ice around an exterior surface of a container in accordance with claim 4 wherein the raised grating platform comprising:

a circular body member having a central opening;

a plurality of members coupled to the circular body member and extending out and away from the circular body member.

6. A device for forming ice around an exterior surface of a container in accordance with claim 5 wherein the raised grating platform further comprising a circular ridge extending up from the plurality of members, the circular ridge used to hold a bottom of the container.

7. A device for forming ice around an exterior surface of a container in accordance with claim 1 further comprising:

a first lip member form around an outer perimeter of the open bottom end of the upper piece;

a second lip member formed around an outer perimeter of the open top end of the lower member; and a rubber seal positioned between the first lip member and the second lip member to form a watertight seal when the upper piece is placed on top of the lower piece.

8. A device for forming ice around an exterior surface of a container in accordance with claim 7 further comprising a plurality of connectors to secure the upper piece to the lower piece.

9. A device for forming ice around an exterior surface of a container in accordance with claim 8 wherein each connector comprises:

a body section coupled to a bottom section of the upper piece; and a hook member coupled to the body member which engages the second lip.

10. A device for forming ice around an exterior surface of a container in accordance with claim 1 further comprising a mold inserted into the upper piece.

11. A device for forming ice around an exterior surface of a container in accordance with claim 1 further comprising a tray to elevate the device and to catch any water that may leak and form around the device.

12. A device for forming ice around an exterior surface of a container in accordance with claim 1 wherein the raised floor comprises:

a plurality of raised slats extending from an interior side wall of the lower piece towards the opening formed in the bottom surface of the lower piece; and a ring member coupled to and rises above the raised slats for holding a bottom of the beverage container.

13. A device for forming ice around an exterior surface of a container comprising:

an upper piece, the upper piece being an elongated tubular member having a hollow interior section and an open bottom and top end;

a first lip member form around an outer perimeter of the open bottom end of the upper piece;

a gasket assembly coupled to an upper interior section of the upper piece, the gasket assembly forming a seal around a neck of the container;

a lower piece having an open top end and an opening formed in the bottom surface of the lower piece;

a raised floor formed in a bottom interior section of the lower piece, the raised floor allowing water to collect and freeze underneath the bottom of the container;

a second lip member formed around an outer perimeter of the open top end of the lower member;

a rubber seal positioned between the first lip member and the second lip member to form a watertight seal when the open bottom end of the upper piece mates with the open top end of the lower piece;

a plurality of connectors to secure the upper piece to the lower piece; and a cap to close the opening in the bottom surface of the lower piece.

14. A device for forming ice around an exterior surface of a container in accordance with claim 13 further comprising:

a protrusion removably coupled to the top open end of the upper piece, the protrusion having a hollow interior section and extending up from the top open end of the upper piece 14; and a plurality of connectors for removably coupling the protrusion to the top open end of the upper piece.

15. A device for forming ice around an exterior surface of a container in accordance with claim 13 wherein the gasket assembly comprises:

a body section removably coupled to the upper interior section of the upper piece;

an opening formed in a central region of the body section; and a gasket coupled around the opening in the body section.

16. A device for forming ice around an exterior surface of a container in accordance with claim 12 further comprising a raised grating platform removably coupled to the raised floor, the raised grating platform is used to elevate shorter beverage containers within the device.

17. A device for forming ice around an exterior surface of a container in accordance with claim 16 wherein the raised grating platform comprising:

a circular body member having a central opening;

a plurality of members coupled to the circular body member and extending out and away from the circular body member; and a circular ridge extending up from the plurality of members, the circular ridge used to hold a bottom of the container.

18. A device for forming ice around an exterior surface of a container in accordance with claim 13 further comprising a mold inserted into the upper piece.

19. A device for forming ice around an exterior surface of a container in accordance with claim 13 further comprising a tray to elevate the device and to catch any water that may leak and form around the device.

20. A device for forming ice around an exterior surface of a container in accordance with claim 13 wherein the raised floor comprises:

a plurality of raised slats extending from an interior side wall of the lower piece towards the opening formed in the bottom surface of the lower piece; and a ring member coupled to and rises above the raised slats for holding a bottom of the beverage container.

21. A method for forming ice around a beverage container comprising the steps of:

providing an upper piece, the upper piece being an elongated tubular member having a hollow interior section and an open bottom and top end, a first lip member form around an outer perimeter of the open bottom end of the upper piece;

providing a gasket assembly coupled to an upper interior section of the upper piece, the gasket assembly forming a seal around a neck of the beverage container;

providing a lower piece having an open top end and an opening formed in the bottom surface of the lower piece, a second lip member formed around an outer perimeter of the open top end of the lower member;

positioning a raised grating platform in a bottom interior of the lower piece, the raised grating platform allowing water to collect and freeze underneath a bottom of the beverage container;

placing the beverage container on the raised grating platform in the interior of the lower piece;

positioning a rubber seal between the first lip member and the second lip member to form a watertight seal when the open bottom end of the upper piece mates with the open top end of the lower piece;

attaching the upper piece to the lower piece to seal an open end of said hollow upper piece mold means;

securing the upper piece to the lower piece to form a watertight seal, the upper piece placed over the beverage container and on top of the lower piece, the gasket assembly creating a seal around the neck of the beverage container;

attaching a plurality of connectors to secure the upper piece to the lower piece;

pouring water in the opening formed in the bottom surface of the lower piece;

inserting a cap to close the opening in the bottom surface of the lower piece; and placing the combined upper piece and lower piece in a freezer to form ice around an exterior portion of the beverage container.

* * * * *